US011297938B2

(12) United States Patent
Kojima

(10) Patent No.: US 11,297,938 B2
(45) Date of Patent: Apr. 12, 2022

(54) LONG LEG FIXING DEVICE

(71) Applicant: KOJIMA METAL FITTING CORPORATION, Tokyo (JP)

(72) Inventor: Morio Kojima, Tokyo (JP)

(73) Assignee: KOJIMA METAL FITTING CORPORATION, Tokyo (JP)

( * ) Notice: Subject to any disclaimer, the term of this patent is extended or adjusted under 35 U.S.C. 154(b) by 0 days.

(21) Appl. No.: 17/252,607

(22) PCT Filed: Nov. 6, 2018

(86) PCT No.: PCT/JP2018/041245

§ 371 (c)(1),
(2) Date: Dec. 15, 2020

(87) PCT Pub. No.: WO2020/095370

PCT Pub. Date: May 14, 2020

(65) Prior Publication Data

US 2021/0251381 A1 Aug. 19, 2021

(51) Int. Cl.

| | |
|---|---|
| ***A47B 3/00*** | (2006.01) |
| ***A47B 3/08*** | (2006.01) |
| ***A47B 3/091*** | (2006.01) |

(52) U.S. Cl.
CPC ..... *A47B 3/0815* (2013.01); *A47B 3/0917* (2013.01)

(58) Field of Classification Search
CPC ..... A47B 3/00; A47B 3/0815; A47B 3/0917; A47B 3/02; A47B 3/0916;
(Continued)

(56) References Cited

U.S. PATENT DOCUMENTS 502,929 A * 8/1893 Maddox ..... A47B 3/0912 108/131
2,478,502 A * 8/1949 Peterson ..... A47B 3/0917 108/132

(Continued)

FOREIGN PATENT DOCUMENTS

DE 202012009964 U1 * 11/2012 ..... A47B 3/0916
DE 102016012638 A1 4/2018

(Continued)

OTHER PUBLICATIONS

International Search Report for International Application No. PCT/JP2018/041245 dated Jan. 8, 2019 (3 sheets, 1 sheet translation, 4 sheets total).

(Continued)

*Primary Examiner* — Janet M Wilkens
(74) *Attorney, Agent, or Firm* — Kratz, Quintos & Hanson, LLP

(57) ABSTRACT

A long leg fixing device for a table that is erected using four long legs having a structure in which two of the long legs are linked by means of a crossbeam portion, and the two long legs are fitted to the table in such a way as to be capable of pivoting by means of a hinge, move together to open and close the legs, comprising: a base fixed to the table; a lever that swings around the arm pin inserted through the base; and an arm and a latch adapted to be interlocked with the swing of the lever; whereby said arm and said latch grip a seat portion mounted on a crossbeam portion. The device maintains the open-leg state by means of engagement with a component on the side surface of the linking crosspiece, and facilitates an operation to release a closed-leg state.

4 Claims, 13 Drawing Sheets

(58) Field of Classification Search
CPC ..... A47B 2003/0824; A47B 2003/025; A47B 2200/0026; A47B 2200/0034; Y10T 403/32254; Y10T 403/322262; Y10T 403/32271; F16B 12/44; F16B 12/52
USPC ..... 108/115, 126, 130–133, 160; 248/166, 248/439, 188.6
See application file for complete search history.

(56) References Cited

U.S. PATENT DOCUMENTS

| | | | | | |
|---|---|---|---|---|---|
| 4,238,100 | A * | 12/1980 | Shy | F16M 11/38 108/132 |
| 2003/0167980 | A1* | 9/2003 | Suzuki | A47B 3/0815 108/129 |
| 2019/0307243 | A1* | 10/2019 | Lee | A47B 3/0815 |

FOREIGN PATENT DOCUMENTS

| | | | | |
|---|---|---|---|---|
| DE | 202019107235 | U1 * | 1/2020 | A47B 3/0818 |
| EP | 1145665 | A1 | 10/2001 | |
| FR | 2618653 | A * | 2/1989 | |
| GB | 2272833 | A * | 6/1994 | A47B 3/0815 |
| JP | H02-38929 | U | 3/1990 | |
| JP | 2819052 | B2 | 10/1998 | |
| JP | 2008-229326 | A | 10/2008 | |
| WO | 03/086146 | A1 | 10/2003 | |

OTHER PUBLICATIONS

Written Opinion of the International Searching Authority for International Application No. PCT/JP2018/041245 dated Jan. 8, 2019 (3 sheets, 2 sheets translation, 5 sheets total).
Supplementary European Search Report for European Patent Application No. 18939245 dated Oct. 8, 2021 (2 sheets).

* cited by examiner

LONG LEG FIXING DEVICE

TECHNICAL FIELD

The present invention relates to a foldable table, and more particularly, to fixing legs hinged to a table top plate.

BACKGROUND ART

A table may have a structure that allows it to be folded, assuming that it is stored when not in use. The table, which has the structure in which the top plate is folded vertically, has various functions according to the storage form, such as tilting one top plate or tilting top plates so as to separate and face each other. On the other hand, the table having the structure in which the legs are folded also has various functions such as folding the legs one by one or folding the plurality of legs in conjunction with each other.

For the tables with the foldable structure, it is important to fix the top plate or legs during use. If the top plate or legs are unintentionally folded during use, not only will the articles placed on the top plate be scattered, but there is a risk of causing an injury to the user.

As a mechanism for fixing the foldable top plate, table in which a claw-shaped member is locked to a step portion and the top plate is restrained in a horizontal posture is disclosed (cf patent document 1).

DESCRIPTION OF THE PRIOR ART

Patent Documents

[Patent Document 1] Japanese Unexamined Patent Application Publication No. 2004-187851

[Patent Document 1] Japanese Unexamined Patent Application Publication No. H4-54905

DISCLOSURE OF THE INVENTION

Problems to be Solved by the Invention

In the table having the structure for locking the engaging portion and the metal fitting at the tip of the swing member described above, there an advantage of few unsteadiness at the time of opening the leg by matching of the shapes of the metal fitting and the linking crosspiece. However, there is a limit to the elastic force of the spring, and especially when the elastic force is insufficient for long legs and an unexpected external force not from the release operation acts on the swing member, the engagement is suddenly released and the legs may be folded. Further, if the elastic force of the spring is excessive, there is a concern that the linking crosspiece may be deformed, creating a problem that the linking crosspiece and leg must be strengthened.

Therefore, the objective of the present invention is to provide a long leg fixing device which, while maintaining the conventional effect of suppressing unsteadiness when legs are open by supporting a bottom surface and a side surface of a linking crosspiece, maintains the open-leg state by means of engagement with a component on the side surface of the linking crosspiece, without relying on e elastic force of a spring, and at the same time facilitating an operation release a closed-leg state.

Means for Solving the Problem

That is, the present invention is intended to achieve above-mentioned object, and the means of claim 1 is a long leg fixing device for a table that is erected using four long legs having a structure in which two of the long legs are linked by means of a crossbeam portion, and said two long legs are fitted to the table in such a way as to be capable of pivoting by means of a hinge, move together to open and close the legs, comprising: a base fixed to the table; a lever that swings around the arm pin inserted through the base; and an arm and a latch adapted to be interlocked with the swing of the lever; whereby said arm and said latch grip a seat portion mounted on a crossbeam portion.

The claim 2 is directed to the long leg fixing device, wherein by the operation by the lever, the latch slides and releases the seat portion as the first step and the arm swings to release the lock with the seat portion as the second step.

The claim 3 is directed to the long leg fixing device, further including a hook that moves together with the swing of the lever, and said hook engages with a base pin included in the base, and the arm being fixed to lock the crossbeam portion.

The claim 4 is directed to the long leg fixing device, wherein by the operation by the lever, the hook and the base pin are released as the first step and the arm swings to release the lock with the seat portion as the second step.

Effects of the Invention

Since the long leg fixing device of the present invention grips the crossbeam portion by the arm and the latch, there is an advantage that the maintenance of the open leg state does not need to rely a strong spring for engaging the crosspiece and the arm. In addition, by operating the lever, the mechanism enables two-step operation of releasing the fixed state of the long leg as the first step and swinging the arm as the second step, so that the long leg can be operated only by operating the lever. The fixing can be released and the long legs can be easily opened and closed.

DESCRIPTION OF EMBODIMENTS

In the present invention, the following embodiments will now be described with reference to the accompanying drawings.

Embodiment 1

Figure 1:
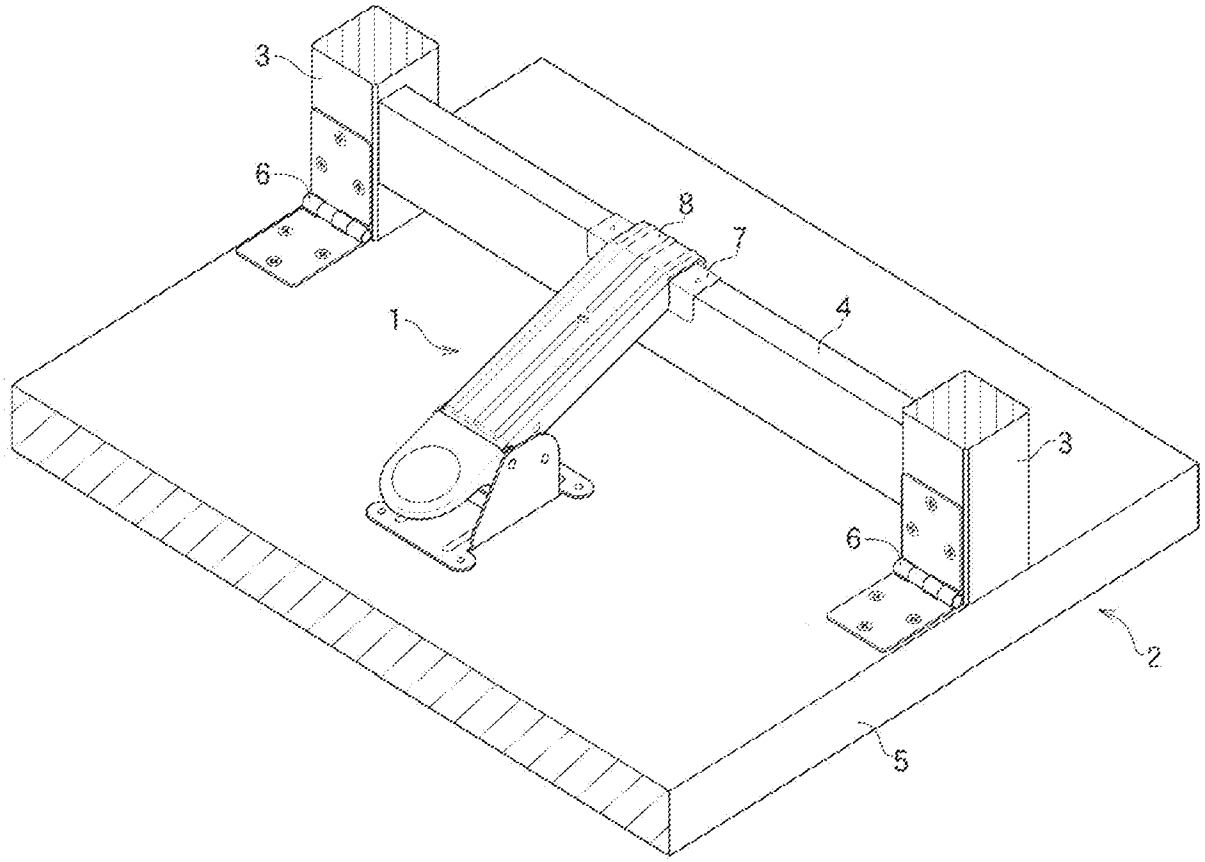
FIG. 1 is a perspective view showing the table provided with the long leg fixing device in the present invention, in which the long leg fixing device grips the crossbeam portion between the opened long legs.

A long leg fixing device 1 in the present invention is used for a table that is erected using four long legs having a structure in which two of the long legs are linked by means of a crossbeam portion, and said two long legs are fitted to the table in such a way as to be capable of pivoting by means of a hinge, move together to open and close legs. FIG. 1 is a perspective view showing the table 2 provided with the long leg fixing device 1 in the present invention, in which the long leg fixing device 1 grips a crossbeam portion 4 between opened long legs 3, and seen from the back surface of a top plate 5. In this embodiment, the back surface side of the top plate 5 may be referred to as the underside surface. The long legs 3 are fitted to the table 2 by hinges 6, and the two long legs 3 are linked by the crossbeam portion 4. The other two legs (not shown) may also been gripped by providing the other long fixing device on the back surface of the table 2.

Figure 2:
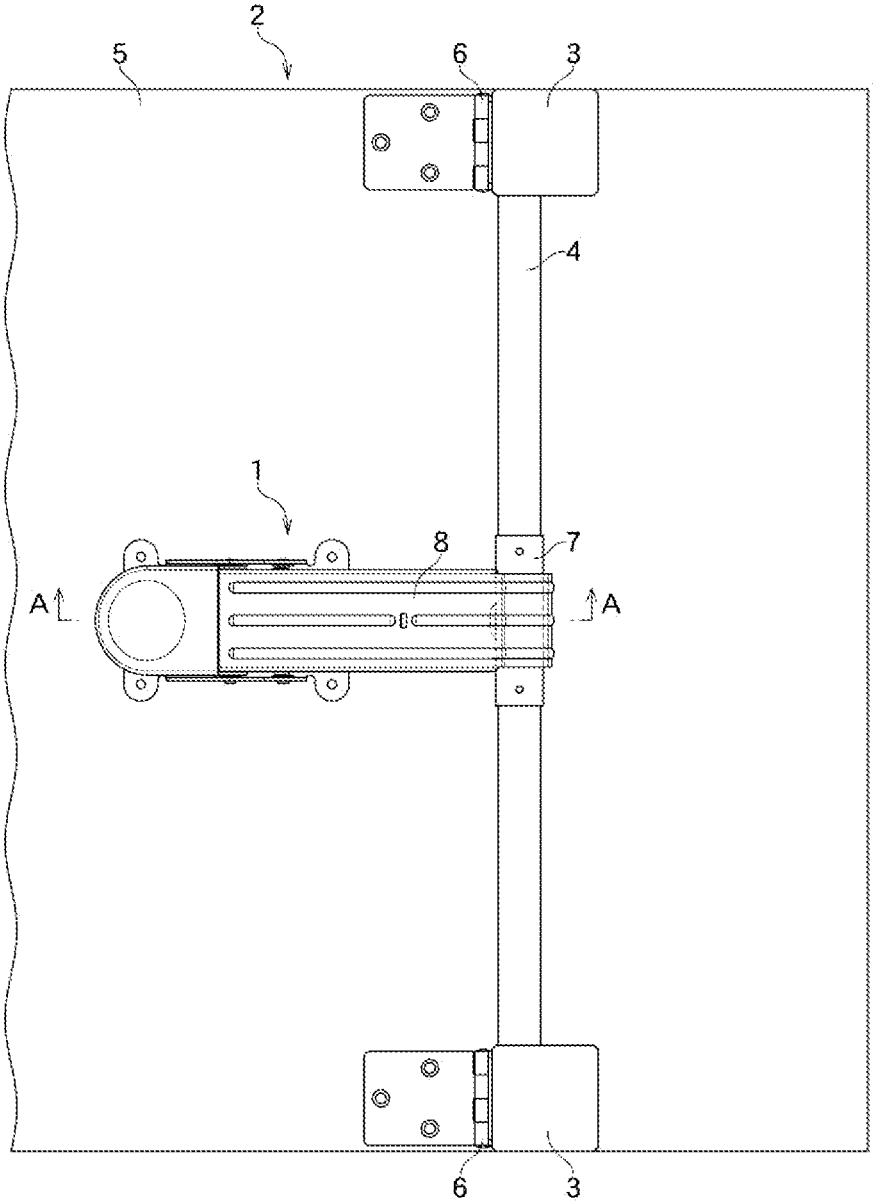
FIG. 2 is a bottom view showing the table provided with the long leg fixing device in the present invention, in which the long leg fixing device grips the crossbeam portion of the opened long leg.

FIG. 2 is bottom view showing the table 2 provided with the long leg fixing device 1 in the present invention, in which the long leg fixing device 1 grips the crossbeam portion 4 of the opened long legs 3. At the center of the crossbeam portion 4, a seat portion 7 formed to an approximately U-shaped cross section is mounted so as to surround a part of three surfaces of the crossbeam portion 4. In the open-leg state, the tip end portion of an arm 8 of the long leg fixing device 1 is locked to the seat portion 7. The fixing means of the seat portion 7 is not limited hereto, but an alternative example thereof includes fixing means using screws.

Figure 3:
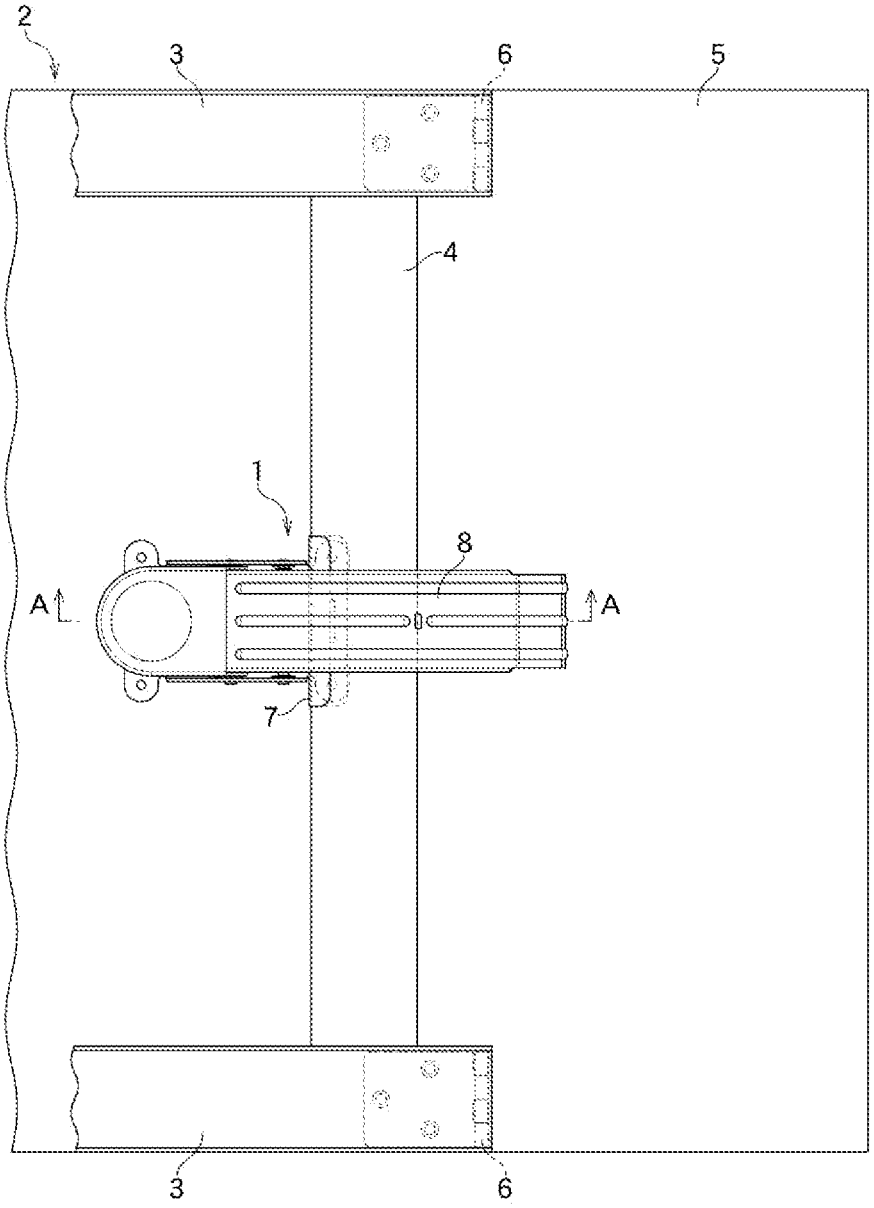
FIG. 3 is a bottom view showing the table provided with the long leg fixing device in the present invention, in which the long leg fixing device locks the crossbeam portion of the closed long legs.

FIG. 3 is a bottom view showing the table 2 provided with the long leg fixing device 1 in the present invention, in which the long leg fixing device 1 locks the crossbeam portion 4 of the closed long leg 3. In the closed leg state, a long plate portion of the arm 8 of the long leg fixing device 1 is fixed at a position parallel to the top plate 5.

Figure 4:
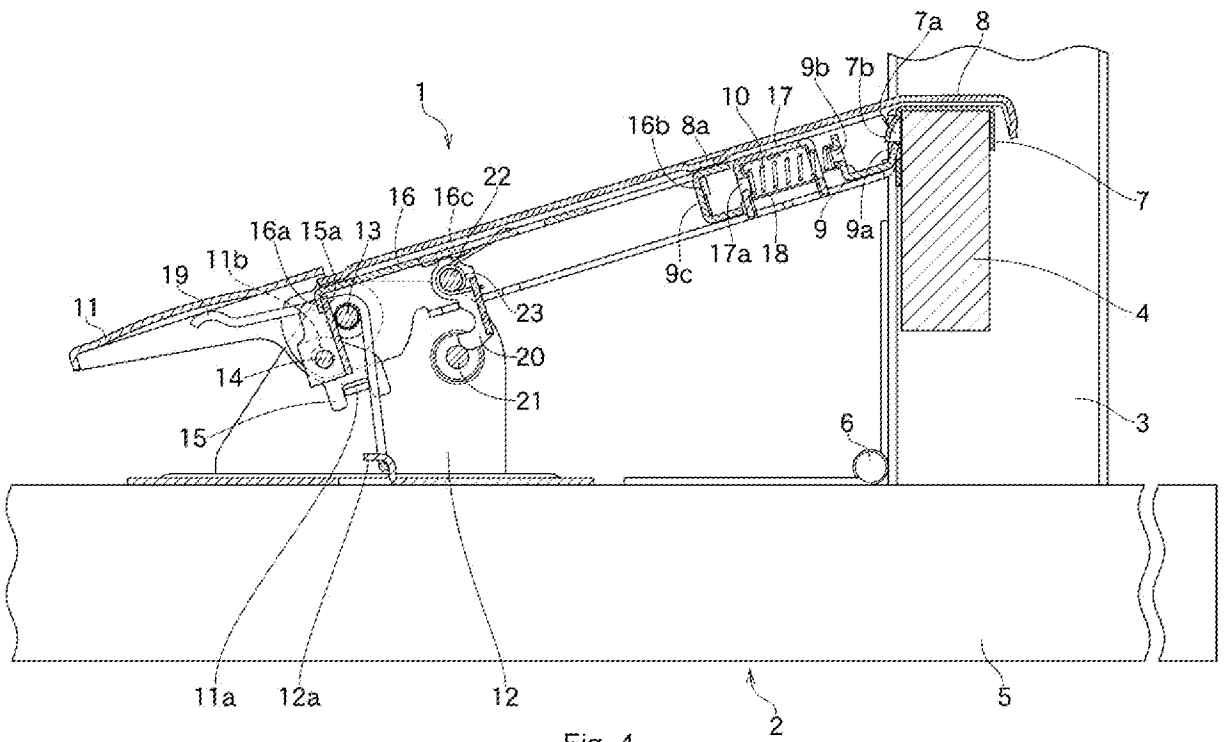
FIG. 4 is a cross-sectional view showing the table provided with the long leg fixing device in the present invention, in which the long leg fixing device grips a crossbeam portion of the opened long leg.
Figure 5:
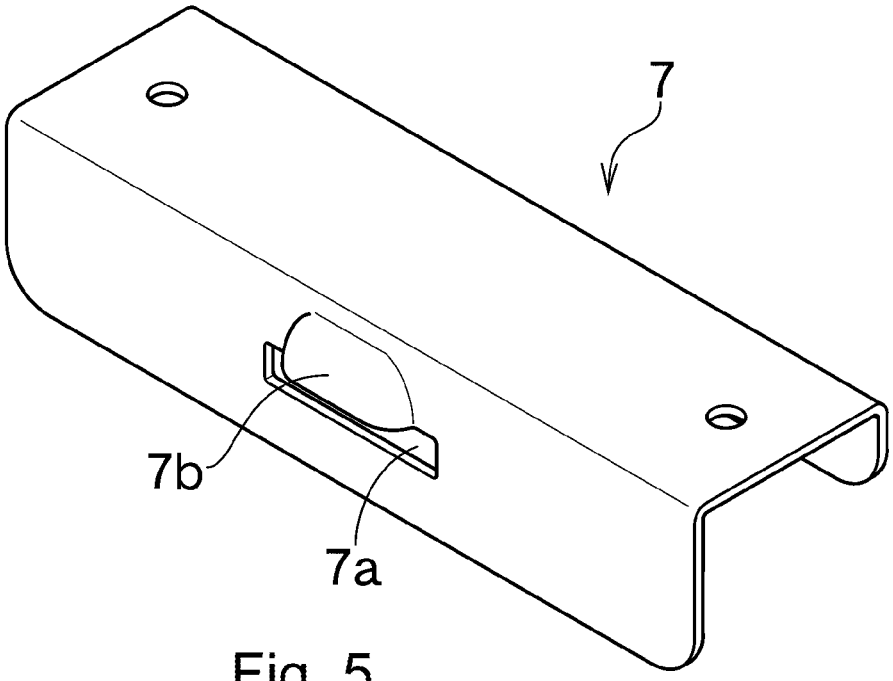
FIG. 5 is a perspective view of the seat portion of the long leg fixing device in the present invention.
Figure 6:
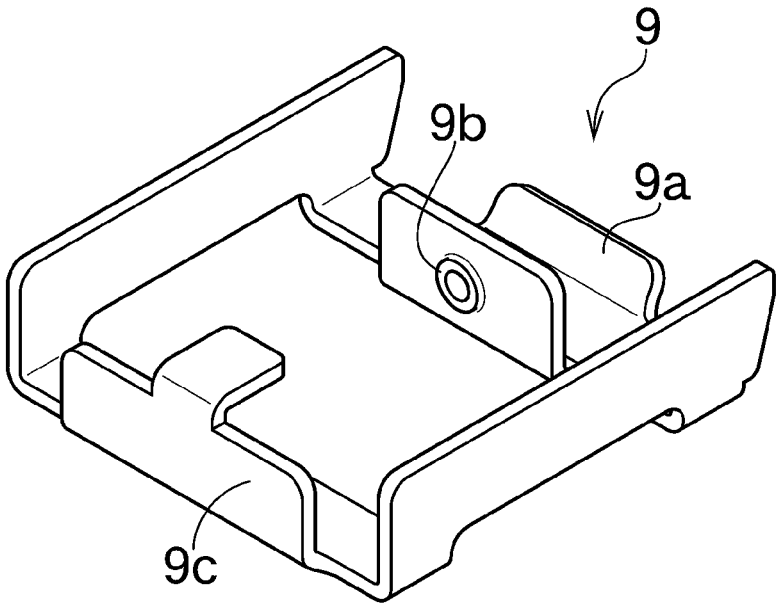
FIG. 6 a perspective view of the latch of the long leg fixing device in the present invention.

FIG. 4 is a cross-sectional view showing the table 2 provided with the long leg fixing device 1 in the present invention, in which the long leg fixing device 1 grips the crossbeam portion 4 of the opened long legs 3, and taken along the line A-A of FIG. 2. And, FIG. 5 is a perspective view of the seat portion 7. The arm 8 is a component formed by bending a plate-shaped member, and has a space inside. Inside the arm 8, a latch 9 is slidably housed in a longitudinal direction of the arm 8. FIG. 6 is a perspective view of the latch 9. In the open-leg state, the claw portion 9*a* of the latch 9 is locked to an opening portion 7*a* and a raised portion 7*b* of the seat portion 7 by the urging of the latch spring 10.

The width of the claw portion 9*a* of the latch 9 formed to be narrower than the width of the opening portion 7*a* of the seat portion 7 and wider than the width of the raised portion 7*b*. When the long leg fixing device 1 grips the crossbeam portion 4 of the opened long legs 3, the claw portion 9*a* gets into the opening portion 7*a* and comes into contact with the raised portion 7*b*. In this way, when the claw portion 9*a* is locked to the opening portion 7*a* and the raised portion 7*b*, the seat portion 7 is in a state of being gripped by the arm 8 and the latch. The open-leg state of the long leg 3 linked to the crossbeam portion 4 is maintained by the seat portion 7 mounted thereto.

Figure 7:
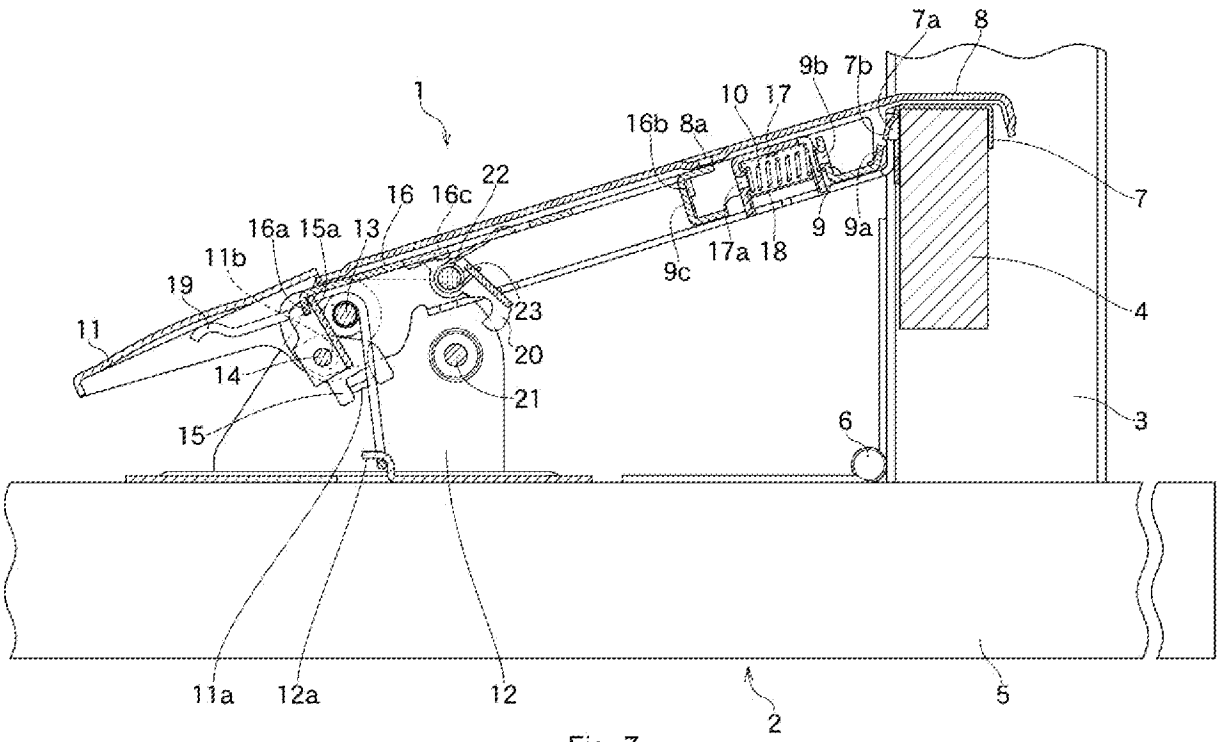
FIG. 7 is a cross-sectional view showing the table provided with the long leg fixing device in the present invention, in which the long leg fixing device is released from gripping the crossbeam portion of the opened long leg.

FIG. 7 is a cross-sectional view showing a state in which the table 2 provided with the long leg fixing device 1 in the present invention is released from gripping the crossbeam portion 4 of the opened long leg 3. The cutting line is the same as the line A-A in FIG. 2. In the long leg fixing device 1 in the present invention the internal mechanism of the arm 8 is operated by a lever 11. The arm 8 and the lever 11 swing around an arm pin 13 inserted into a base 12 fixed to the top plate 5 of the table 2. Further, the arm 8 and the lever 11 have a cam pin 14 which is not inserted into the base 12 as a common shaft. The cam pin 14 is a shaft that allows the lever cam 15 to swing. The fixing means of the base 12 is not limited thereto, but an alternative example thereof includes fixing means using screws.

Figure 8:
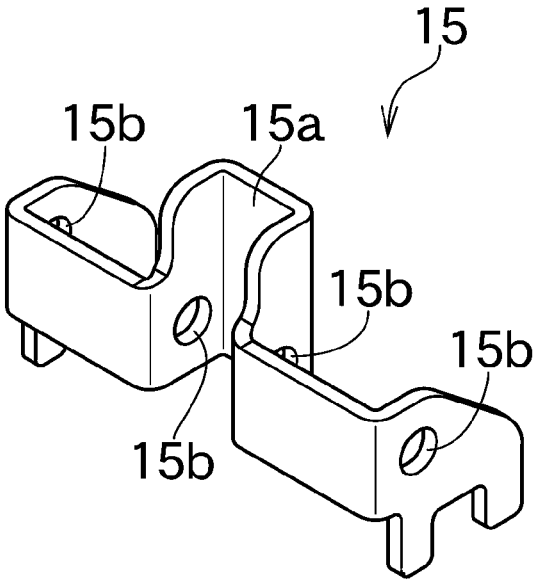
FIG. 8 is a perspective view of the lever cam of the long leg fixing device in the present invention.
Figure 9:
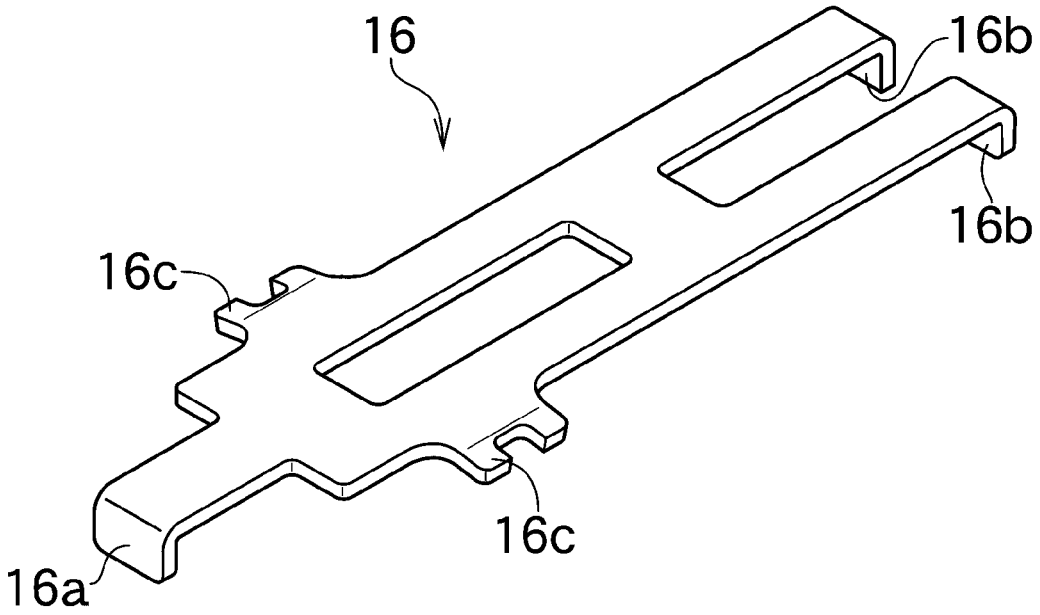
FIG. 9 is a perspective view of the link plate of the long leg fixing device in the present invention.

FIG. 8 is a perspective view of the lever cam 15. The diameter of a pin hole 15*b* through which the cam pin 14 is inserted is formed to be slightly larger than the diameter of the body portion of the cam pin 14, and the pin hole 11*b* of the lever 11 is formed in the shape of a slot. The diameter of the pin hole (not shown) of the arm 8 is also formed to be slightly larger than the diameter of the body portion of the cam pin 14, similarly to the pin hole 15*b*. Further, FIG. 9 is a perspective view of a link plate 16. The claw portion 16*b* of the link plate 16 engages with a link plate receiving port ion 9*c* of the latch 9.

As shown in FIG. 7, when the lever 11 is operated and slightly pushed toward the top plate 5, the lever cam 15 that engages with the claw portion 11*a* of the lever 11 swings around the cam pin 14 in response to the swing of the lever 11. At this time, the position of the cam pin 14 inserted into the arm 8 which has not yet swung will not change. Even if the position of the cam pin 14 does not change, since the pin hole 11*b* of the lever 11 has the shape of the slot, a slight swing of the lever 11 about the arm pin 13 is allowed. The lever cam 15 is provided with a hanging plate portion 15*a* in the center thereof, comes into contact with a base portion 16*a* of the link plate 16. The link plate 16 is moved in the direction of the lever 11 according to the swing of the lever cam 15. The link plate 16 includes a claw portion 16*b* and interlocks with a latch 9 that engages with the claw portion 16*b*. A latch receiver 17 and push plate 18 are arranged inside the latch 9, and a latch spring 10 is arranged in a space surrounded by the latch receiver 17 and the push plate 18. The latch spring 10 is a compression coil spring, which is locked to the base portion 17*a* of the latch receiver 17 and the spring receiver portion 9*b* of the latch 9, and always urges the latch 9 and the latch receiver 17.

In the state of FIG. 2 in which the arm 8 and the latch 9 grip the crossbeam portion 4 of the opened long legs 3, the latch spring 10 urging the latch 9 maintain the state of the claw portion 9*a* to lock the opening 7*a*. The latch receiver 17 and the push plate 18 are locked to the arm 8 and do not interlock with the latch 9. By the cooperation of the internal mechanism of the arm 8 starting from the operation by the lever 11, the latch 9 slides and releases the seat portion 7 as the first step in the crossbeam portion 4 to which the seat portion 7 is mounted. At this time, the crossbeam portion 4 thus released from the gripping is locked by the arm 8 as shown in FIG. 7.

Figure 10:
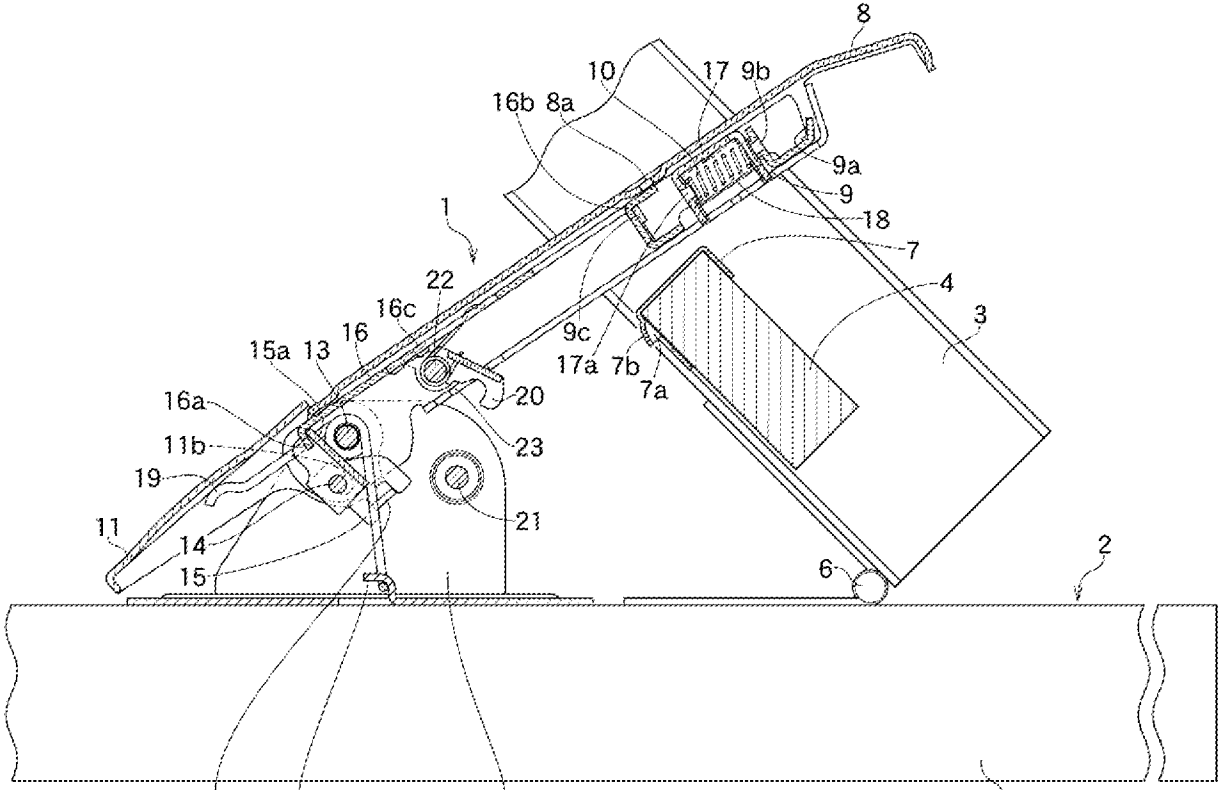
FIG. 10 is a cross-sectional view showing the table provided with the long leg fixing device in the present invention, in which the long legs are in the middle of the closed or opened.

FIG. 10 is a cross-sectional view showing a table 2 provided with the long leg fixing device 1 in the present invention, in which the long legs 3 are in the middle of closed or opened state. The cutting line is the same as the A-A line of FIG. 2 or FIG. 3. When the lever 11 is further pushed in from the state where the crossbeam portion 4 and the latch 9 are unlocked, the cam pin 14 is locked with the arm 8 as the second step, the lever 11 and the arm 8 start interlocking and moving together. And, the arm 8 swings around the arm pin 13. Here, in the crossbeam portion 4 to which the seat portion 7 is mounted, the lock between the arm 8 and the seat portion 7 is released, and the long legs 3 linked to the crosspiece 4 may be closed. The arm pin 13 inserted into the coil of a torsion coil spring 19 that types as the double torsion. An arm portion of the torsion coil spring 19 is engaged with a spring receiving portion (not shown) of the lever 11, and the intermediate portion of the torsion coil spring 19 is engaged with a spring receiving portion 12*a* of the base 12 to urge the lever 11. Therefore, the operation of pushing the lever 11 in the direction of the top plate 5 requires a constant load.

Figure 11:
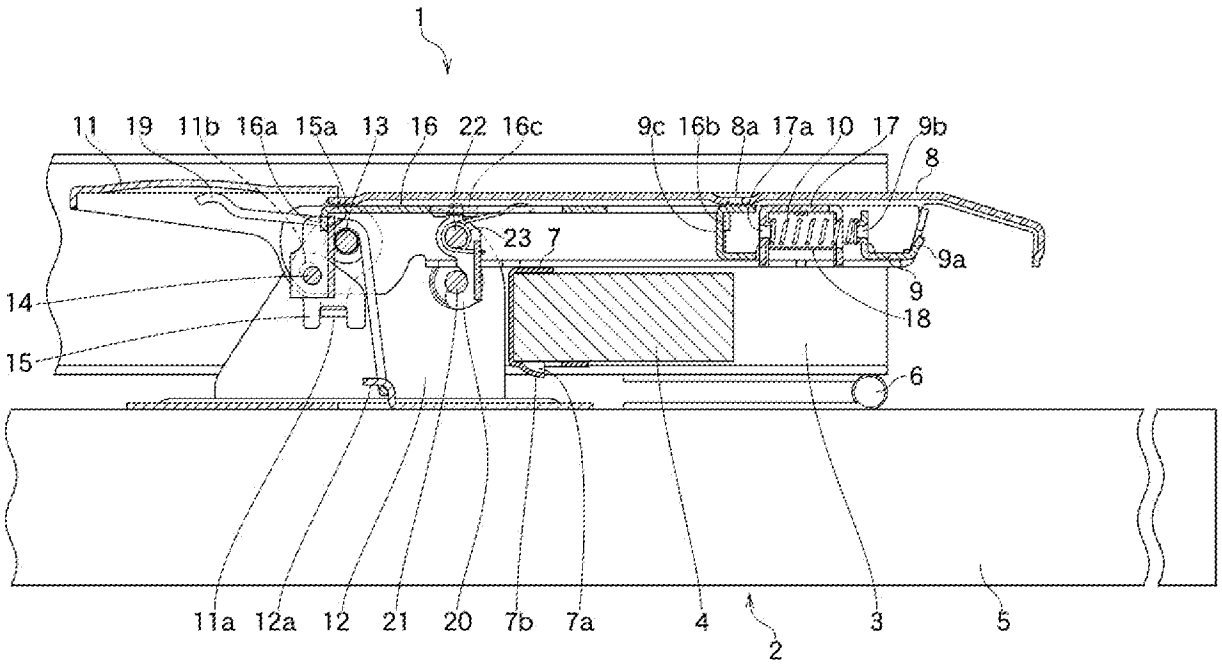
FIG. 11 is a cross-sectional view showing the table provided with the long leg fixing device in the present invention, in which the long leg fixing device locks the crossbeam portion of the closed long legs.

FIG. 11 is a cross-sectional view taken along the line A-A of FIG. 3 showing a table 2 provided with the long leg fixing device 1 in the present invention, in which the long leg fixing device 1 locks the crossbeam portion 4 of the closed long leg 3. The long legs 3 that can be closed reach the closed-leg state of FIG. 11 via the state of FIG. 10. The closed-leg state is maintained by engaging a hang portion 20*a* of a hook 20 with a base pin 21. The base pin 21 is attached to the base 12. The hook pin 22 attached to the arm 8 serves as a shaft of the hook 20, and the hook 20 interlocks with the swing of the arm 8.

Figure 12:
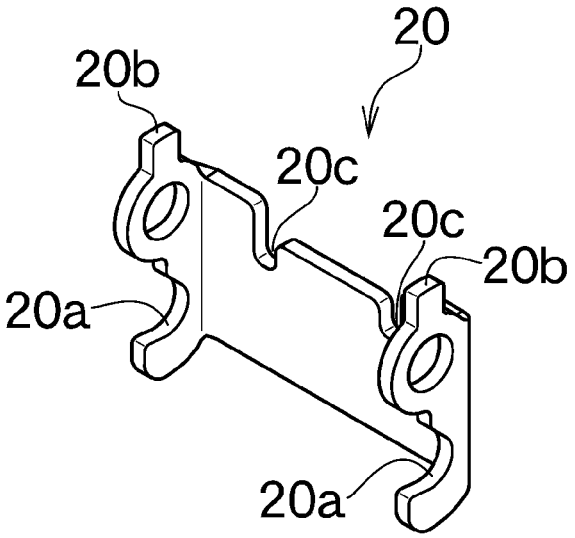
FIG. 12 is a perspective view of the hook of the long leg fixing device of the present invention.

FIG. 12 is a perspective view of the hook 20. A claw portion 20*b* of the hook 20 engages with the claw receiving portion 16*c* of the link plate 16. The hook 20 moving together the hook pin 22 as the link plate 16 moves in conjunction with the swing of the lever 11. The hook pin 22 is inserted into the coil of a torsion coil spring 23 that types as the double torsion. An arm portion of the torsion coil spring 23 is engaged with a spring receiving portion (not shown) of the Arm 8, and the intermediate portion of the torsion coil spring 23 is engaged with a spring receiving portion 20*c* of the hook 20 to urge the hook 20. When the long leg 3 is closed and the load of the lever 11 is removed, the hook 20 swings due to the urging of the torsion coil spring 23 and engages with the base pin 21. When the hook 20 is engaged with the base pin 21, the arm 8 is fixed to the base 12 and do not swing. At this time, the crossbeam portion 4 is locked to the arm 8, and the long legs do not open.

Figure 13:
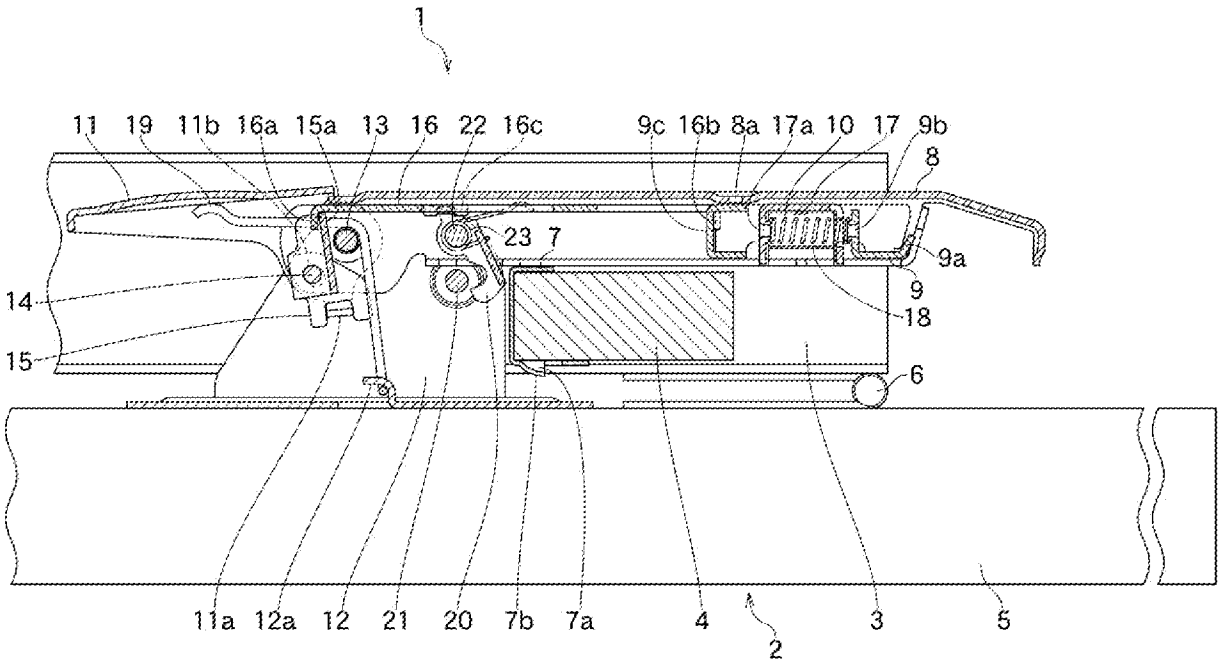
FIG. 13 is a cross-sectional view showing the table provided with the long leg fixing device in the present invention, in which the long leg fixing device is capable of the opening the legs from the state in which the crossbeam portion of the closed long legs are locked.

FIG. 13 is a cross-sectional view showing the table 2 provided with the long leg fixing device 1 in the present invention, in which the long leg fixing device 1 is capable of the opening the legs 3 from the state in which the crossbeam portion 4 of the closed long legs 3 are locked. The cutting line is the same as the line A-A in FIG. 3. When the lever 11 is operated and slightly pushed toward the top plate 5, the lever cam 15 and the link plate 16 are interlocked as the first step, the hook swings, and the hook 20 and the base pin 21 are released. When the lever 11 is further pushed in from the state where hook 20 and the base pin 21 are released, the cam pin 14 is locked with the arm 8 as the second step, the lever 11 and the arm 8 start interlocking and moving together. And, the arm 8 swings around the arm pin 13. Here, in the crossbeam portion 4, the arm 8 swinging in the direction away from the top plate 5 and the crosspiece 4 are released, and the long legs 3 linked to the crosspiece 4 may be opened. The long legs 3 that can be opened reach the opened-leg state of FIG. 4 via the state of FIG. 10.

The arm 8 of the long leg fixing device 1 in the present invention is provided with a window 8*a* that allows the latch 9 to be visually recognized from the bottom surface side. Since the latch 9 is interlocked by the operation of the lever 11, the portion of the latch 9 that may be visually recognized from the window 8*a* differs between when the lever 11 is in the reference position and when the lever 11 is in the pushed state. By arranging different colors at each position, it is possible to operate the entire long leg fixing device 1 while checking the operation of the mechanism inside the arm 8.

Since the long leg fixing device 1 in the present invention grips the crossbeam portion 4 by the arm 8 and the latch 9, it is not necessary to rely on a strong spring for engaging the crosspiece 4 and the arm 8 to keep the open-leg state. Further, by operating the lever 11, the mechanism enables two-step operation of releasing the fixed state of the long leg 3 as first step and swinging the arm 8 as the second step, so that only the operation of lever 11 may be released the closed-leg state, and the long leg 3 may be easily opened and closed.

DESCRIPTION OF THE REFERENCE NUMERALS

1 . . . Long leg fixing device.
2 . . . table.
3 . . . Long legs.
4 . . . Crossbeam portion.
5 . . . Top plate.
6 . . . Hinge.
7 . . . Seat portion.
8 . . . Arm.
9 . . . Latch.
10 . . . Latch spring.
11 . . . Lever.
12 . . . Base.
13 . . . Arm pin.
14 . . . Cam pin.
15 . . . Lever cam.
16 . . . Link plate.
17 . . . Latch receiver.
18 . . . Push plate.
19 . . . Torsion coil spring.
20 . . . Hook.
21 . . . Base pin.
22 . . . Hook pin.
23 . . . Torsion coil spring.

The invention claimed is:

1. A long leg fixing device for a table having four long legs and having a structure in which two of the long legs are linked by means of a crossbeam portion, and in which said two long legs are fitted to the table in such a way as to be capable of pivoting by means of a hinge, move together to open and close the legs, said long leg fixing device comprising:

a base that is fixable to a top plate of the table;

an arm pin inserted into said base;

an arm and a lever that can swing around said arm pin, said lever having a claw portion;

a cam pin inserted through said arm and said lever and which is not inserted into the base, said cam pin being a common shaft for said arm and said lever;

a lever cam that can swing around said cam pin as a shaft and that can engage with the claw portion of the lever;

a latch;

a link plate including a base portion and a claw portion that can interlock with said latch;

a hanging plate portion in the center of said lever cam;

such that when said lever is depressed, said hanging plate portion comes into contact with the base portion of the link plate and the claw portion of the link plate interlocks with said latch, such that said arm and said latch are interlocked; and whereby said arm and said latch are configured to be able to grip a seat portion mounted on the crossbeam portion of the table.

2. The long leg fixing device according to claim 1, wherein by the operation by the lever, the latch can slide and release the seat portion in a first step and the arm can swing to release the lock with the seat portion in a second step.

3. The long leg fixing device according to claim 1, further including:

a base pin in said base; and a hook that moves together with the swing of the lever, such that said hook engages with said base pin, and wherein the arm is fixable to lock the crossbeam portion.

4. The long leg fixing device according to claim 3, wherein by the operation by the lever, the hook and the base pin are released in a first step and the arm swings to release the lock with the seat portion in a second step.

* * * * *